US005948710A

United States Patent [19]

Pomplun et al.

[11] Patent Number: 5,948,710

[45] Date of Patent: Sep. 7, 1999

[54] WATER-DISPERSIBLE FIBROUS NONWOVEN COFORM COMPOSITES

[75] Inventors: William Seal Pomplun, Neenah, Wis.; David Martin Jackson, Roswell, Ga.; Pavneet Singh Mumick, Appleton, Wis.

[73] Assignee: Kimberly-Clark Worldwide, Inc., Neenah, Wis.

[21] Appl. No.: 08/798,751

[22] Filed: Feb. 13, 1997

Related U.S. Application Data

[63] Continuation-in-part of application No. 08/497,629, Jun. 30, 1995.

[51] Int. Cl.[6] ..... B32B 5/00

[52] U.S. Cl. ..... 442/341; 442/340; 442/342; 442/350

[58] Field of Search ..... 442/340, 341, 442/342, 350

[56] References Cited

U.S. PATENT DOCUMENTS 5,500,068 3/1996 Srinivasan et al. ..... 156/148

FOREIGN PATENT DOCUMENTS

97/02376 1/1997 WIPO ..... D04H 1/42

*Primary Examiner*—Richard Weisberger
*Attorney, Agent, or Firm*—James B. Robinson

[57] ABSTRACT

Disclosed herein is a fibrous nonwoven composite structure more commonly referred to as a coform structure. Unlike current coform structures, the material of the present invention is more water-dispersible due to the use of a water-degradable reinforcing fiber matrix.

23 Claims, 4 Drawing Sheets

WATER-DISPERSIBLE FIBROUS NONWOVEN COFORM COMPOSITES

This application is a continuation-in-part of application Ser. No. 08/497,629, entitled "WATER-DISPERSIBLE FIBROUS NONWOVEN COFORM COMPOSITES" and filed in the U.S. Patent and Trademark Office on Jun. 30, 1995. The entirety of this application is hereby incorporated by reference.

FIELD OF THE INVENTION

The present invention relates to water-dispersible fibrous nonwoven composite structures comprising at least two different components wherein the composite is water-dispersible. More particularly, the present invention relates to fibrous nonwoven composite structures referred to as "coform" materials which are water-dispersible.

BACKGROUND OF THE INVENTION

Fibrous nonwoven materials and fibrous nonwoven composite materials are widely used as products or as components of products because they can be manufactured inexpensively and can be made to have specific characteristics. One approach has been to mix thermoplastic polymer fibers with one or more types of fibrous material and/or particulates. The mixtures are collected in the form of fibrous nonwoven web composites which may be bonded or treated to provide coherent nonwoven composite materials that take advantage of at least some of the properties of each component. For example, U.S. U.S. Pat. No. 4,100,324 issued Jul. 11, 1978 to Anderson et al. discloses a nonwoven fabric which is generally a uniform admixture of wood pulp and meltblown thermoplastic polymer fibers. U.S. Pat. No. 3,971,373 issued Jul. 7, 1976 to Braun discloses a nonwoven material which contains meltblown thermoplastic polymer fibers and discrete solid particles. According to this patent, the particles are uniformly dispersed and intermixed with the meltblown fibers in the nonwoven material. U.S. Pat. No. 4,429,001 issued Jan. 31, 1984 to Kolpin et al. discloses an absorbent sheet material which is a combination of meltblown thermoplastic polymer fibers and solid superabsorbent particles. The superabsorbent particles are disclosed as being uniformly dispersed and physically held within a web of the meltblown thermoplastic polymer fibers. European Patent Number 0080382 to Minto et al. published Jun. 1, 1983 and European Patent Number 0156160 to Minto et al. published Oct. 25, 1985 also disclose combinations of particles such as superabsorbents and meltblown thermoplastic polymer fibers. U.S. Pat. No. 5,350,624 to Georger et al. issued Sep. 27, 1994 discloses an abrasion-resistant fibrous nonwoven structure composed of a matrix of meltblown fibers having a first exterior surface, a second exterior surface and an interior portion with at least one other fibrous material integrated into the meltblown fiber matrix. The concentration of meltblown fibers adjacent to each exterior surface of the nonwoven structure is at least about 60 percent by weight and the concentration of meltblown fibers in the interior portion is less than about 40 percent by weight. Many of the aforementioned admixtures are referred to as "coform" materials because they are formed by combining two or more materials in the forming step into a single structure.

Coform engineered composites can be used in a wide variety of applications including absorbent media for aqueous and organic fluids, filtration media for wet and dry applications, insulating materials, protective cushioning materials, containment and delivery systems and wiping media for both wet and dry applications. Many of the foregoing applications can be met, to varying degrees, through the use of more simplified structures such as absorbent structures wherein only wood pulp fibers are used. This has commonly been the case with, for example, the absorbent cores of personal care absorbent products such as diapers. Wood pulp fibers when formed by themselves tend to yield nonwoven web structures which have very little mechanical integrity and a high degree of collapse when wetted. The advent of coform structures which incorporated thermoplastic meltblown fibers, even in small quantities, greatly enhanced the properties of such structures including both wet and dry tensile strength. The same enhancements were also seen with the advent of coform wiping sheets.

Many of the items or products into which coform materials are incorporated are generally regarded as being limited use disposable products. By this it is meant that the product or products are used only a limited number of times and in some cases only once before being discarded. With increasing concerns over waste disposal, there is now an increasing push for materials that are, for example, either recyclable or disposable through other mechanisms besides incorporation into landfills. One possible alternative means of disposal for many products, especially in the area of personal care absorbent products and wipers, is by flushing them into sewage disposal systems.

The very reason why many coform materials provide increased benefits over conventional materials, i.e., the meltblown thermoplastic fiber matrix, is the same reason why such materials are more difficult to recycle or flush. Many wood pulp fiber-based products can be recycled by hydrating and repulping the reclaimed wood pulp fibers. However, in coform structures the thermoplastic meltblown fibers do not readily break-up. The meltblown fibers are hard to separate from the wood pulp fibers, and they remain substantially continuous thereby giving rise to the possibility of dogging or otherwise damaging recycling equipment such as repulpers. From the standpoint of flushability, the current belief is that to be flushable, a product must be made from very small and/or very weak fibers so that the material will readily break-up into smaller pieces when placed in quantities of water such as are found in toilets and, again due to the nature of the fibers, when flushed will not be entrained or trapped within the piping of conventional private and public sewage disposal systems. Many of these systems, especially sewer laterals, may have many protrusions within the pipes such as tree roots which will snag any type of material which is still relatively intact. Such would be the case with conventional non-water-degradable meltblown thermoplastic fibers in coform materials. As a result, for at least the foregoing reasons, there is a need for a coform material which has the potential for being more user friendly with respect to recycling processes and disposal through alternative means to landfills such as, for example, flushing. Accordingly, it is an object of the present invention to provide such a material.

SUMMARY OF THE INVENTION

The present invention is directed to a triggerable water-dispersible fibrous nonwoven composite structure which utilizes at least two different components and wherein the composite is water-dispersible. Such structures are more commonly referred to as "coform" materials. The water-dispersible fibrous nonwoven composite structure comprises a matrix of meltspun triggerable water-degradable reinforcing fibers and a multiplicity of discrete absorbent fibers which are disposed within the matrix of meltspun water-degradable reinforcing fibers. The absorbent fibers may include, for example, staple fibers having average fiber lengths of approximately 18 millimeters or less, or more particularly about 15 mm or less, as well as wood pulp fibers. In addition, the water-dispersible fibrous nonwoven composite structure may further include a particulate material within the matrix as such as a superabsorbent and/or an odor reducing agent such as, for example, activated charcoal. The meltspun water-degradable reinforcing fibers are ion triggerable water-degradable polymers like, for examples, certain polyamides and copolyesters. In lieu of or in addition to the multiplicity of discrete absorbent fibers, the water-dispersible fibrous nonwoven composite structure may comprise a plurality of particles disposed within and held by the matrix of meltspun water-degradable reinforcing fibers. The materials of the present invention may be used in a wide variety of dry and substantially dry applications including, for example, personal care absorbent articles such as wipers, diapers, training pants, pantiliners, sanitary napkins, incontinence devices, wound dressings, bandages and the like.

DETAILED DESCRIPTION OF THE INVENTION

Figure 1:
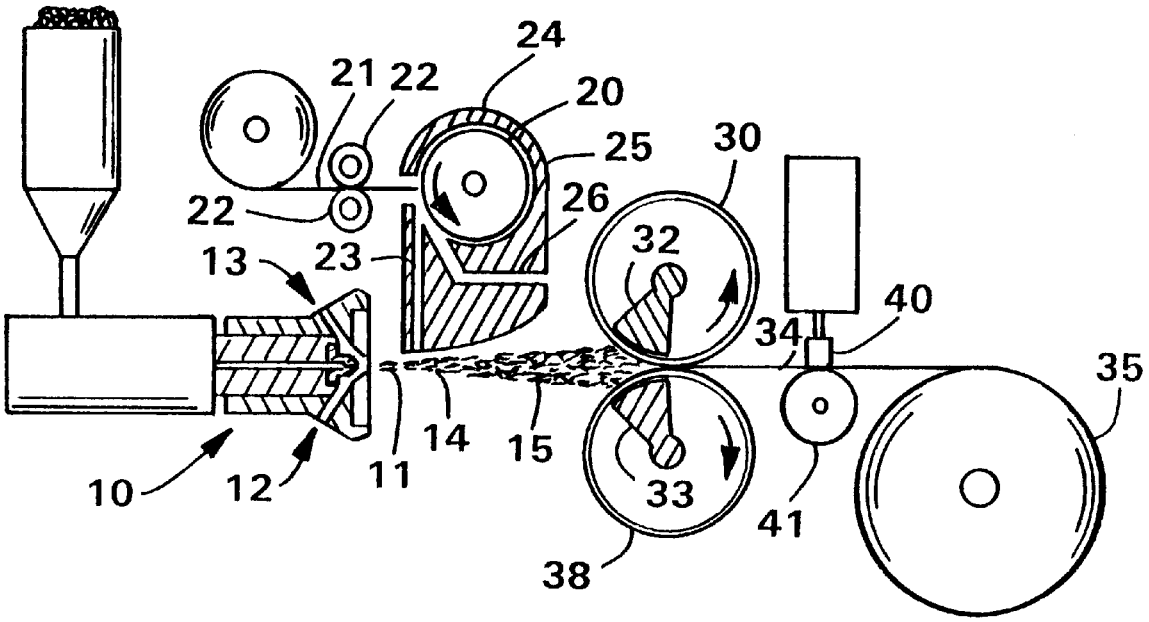
FIG. 1 is a schematic side elevation, partially in section, of a possible method and apparatus for producing water-dispersible fibrous nonwoven composite structures according to the present invention.

The present invention is directed to a fibrous nonwoven composite structure, which has at least two different components which are water-dispersible. As used herein the term "fibrous nonwoven composite structure" refers to a structure of individual fibers or filaments with or without particulates which are interlaid, but not in an identifiable repeating manner. Nonwoven structures such as, for example, fibrous nonwoven webs have been formed in the past, by a variety of processes known to those skilled in the art including, for example; meltblowing and meltspinning processes, spunbonding processes and bonded carded web processes.

As used herein, the term "water-dispersible" refers to a fibrous nonwoven composite structure which when placed in an aqueous environment will, with sufficient time, break apart into smaller pieces. As a result, the structure once dispersed may be more advantageously processable in recycling processes or flushable in, for example, septic and municipal sewage treatment systems. If desired, such fibrous nonwoven structures may be made more water-dispersible or the dispersion may be hastened by the use of agitation and/or certain triggering means as are further described below. The actual amount of time will depend at least in part upon the particular end-use design criteria. For example, in the sanitary napkin embodiments described below, the fibers break apart in less than a minute. In other applications, longer times may be desirable.

The fibrous nonwoven structure according to the present invention includes a meltspun reinforcing fiber made from a water-degradable polymer and one or more other components which are intermixed with the reinforcing fiber to form a fibrous nonwoven composite structure according to the present invention. By "meltspun" it is meant a fiber which is formed by a fiber-forming process which yields longer, more continuous fibers (generally in excess of 7.5 centimeters) such as are made by the meltblown and spunbond processes. By "water-degradable" it is meant a polymer which when formed into a fiber and placed in sufficient quantities of water for a sufficient period of time will break apart into smaller pieces. In some cases, agitation may be necessary to break the fibers apart. Here again the actual time may vary or be varied to meet a particular end-use requirement. Many of the polymers today can be designed or selected to break apart in the order of minutes or less. The most common form of the fibrous nonwoven composite structure according to the present invention is commonly referred to as a "coform" material which includes longer more continuous melt-spun reinforcing fibers intermixed with shorter absorbent fibers such as staple length fibers and wood pulp fibers or particulates such as superabsorbents. Staple length fibers generally have lengths which extend up to approximately 7.5 centimeters. There are many thermoplastic short cut staple fibers currently available which generally have lengths of less than about 18 millimeters, and which can be made from a variety of thermoplastic extrudable polymers including, but not limited to, polyolefins and polyesters as well as homopolymers, copolymers and blends of such polymers. In addition, several different types and/or sizes of such fibers may be used in the coform structure. Another example of absorbent fibers is pulp fibers. Pulp fibers are generally obtained from natural sources such as woody and non-woody plants. Woody plants include, for example, deciduous and coniferous trees. Non-woody plants include, for example, cotton, flax, esparto grass, milkweed, straw, jute, and bagasse. In addition, synthetic wood pulp fibers are also available and may be used with the present invention. Wood pulp fibers typically have lengths of about 0.5 to 10 millimeters and a length-to-maximum width ratio of about 10/1 to 400/1. A typical cross-section has an irregular width of about 30 micrometers and a thickness of about 5 micrometers. One wood pulp suitable for use with the present invention is Kimberly-Clark CR-54 wood pulp from the Kimberly-Clark Corporation of Neenah, Wis. Another is NF405 as from Weyerhauser Corporation of Federal Way, Wash.

The water-degradable reinforcing fibers will typically have lengths in excess of the absorbent fibers including staple and wood pulp fibers. Examples of two such water-degradable reinforcing fibers are meltblown fibers and spunbond fibers. Meltblown fibers are formed by extruding molten thermoplastic material through a plurality of fine, usually circular, die capillaries as molten threads or filaments into a heated high velocity gas stream such as air, which attenuates the filaments of molten thermoplastic material to reduce their diameters. Thereafter, the meltblown fibers are carried by the high velocity gas stream and are deposited on a collecting surface to form a web of randomly dispersed meltblown fibers. The meltblown process is well-known and is described in various patents and publications, including NRL Report 4364, "Manufacture of Super-Fine Organic Fibers" by B. A. Wendt, E. L. Boone and C. D. Fluharty; NRL Report 5265, "An Improved Device For The Formation of Super-Fine Thermoplastic Fibers" by K. D. Lawrence, R. T. Lukas, J. A. Young; U.S. Pat. No. 3,676,242, issued Jul. 11, 1972, to Prentice; and U.S. Pat. No. 3,849,241, issued Nov. 19, 1974, to Buntin, et al. The foregoing references are incorporated herein by reference in their entirety. Such meltblown fibers can be made in a wide variety of diameters. Typically, such fibers will have an average diameter of not greater than about 100 micrometers and usually not more than 15 micrometers.

Spunbond fibers are formed by extruding a molten thermoplastic material as filaments from a plurality of fine, usually circular, capillaries in a spinneret with the diameter of the extruded filaments then being rapidly reduced, for example, by non-eductive or eductive fluid-drawing or other well-known spunbonding mechanisms. The production of spunbond nonwoven webs is illustrated in patents such as Appel et al., U.S. Pat. No. 4,340,563; Matsuki et al., U.S. Pat. No. 3,802,817; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent Number 803,714. All of the foregoing references are incorporated herein by reference in their entirety.

In addition to the water-degradable reinforcing fibers and absorbent fibers such as staple fibers and wood pulp fibers, the fibrous nonwoven structure according to the present invention may employ superabsorbent materials. Superabsorbent materials are absorbent materials capable of absorbing at least 10 grams of aqueous liquid (e.g. distilled water) per gram of absorbent material while immersed in a liquid for four hours and which will hold substantially all of the absorbed liquid while under a compression force of up to about 10 kilopascals (kPa). Superabsorbent materials are produced in a wide variety of forms including, but not limited to, particles, fibers and flakes. Such superabsorbent materials may be used in the present invention in combination with the water-degradable reinforcing fibers and shorter absorbent fibers or in lieu of the staple fibers.

Due to the longer, more continuous nature of the fibers formed by the foregoing meltblown and spunbonding processes, such fibers and resultant nonwoven webs including coform webs do not readily break apart due to the inherent tenacity of the meltblown and/or spunbond fibers. As a result, coform materials which are predominantly wood pulp fibers but which still contain longer fibers such as polyolefin meltblown fibers are difficult to reclaim in such apparatus as repulpers. In addition, these longer, more continuous fibers also tend to hang up in or on proturbances in sewer laterals thereby making such composite materials difficult to transfer through the sewage treatment system. The fibrous nonwoven composite structures according to the present invention use a water-degradable reinforcing fiber which may be made, for example, by the aforementioned and described meltblowing and spunbonding processes.

Not all polymers, of course, may be processed by melt-spinning processes such as meltblowing and spunbonding and the polymers used in the practice of this invention must be meltspinnable and water-degradable. Water-degradable polymers which have been found to be particularly suitable for meltspinning include those with viscosities between 20 and 35000 centipoise at a shear rate of 1000 $sec^{-1}$ at normal processing temperatures of about 75 to about 250° C., depending on the polymer type. These water-degradable polymers, when formed into fibers and mixed with absorbent materials such as staple length and/or wood pulp fibers and/or particulates such as superabsorbents, can form fibrous nonwoven structures referred to as coform materials. These coform materials can have subsequent end uses which involve exposure of the structures to aqueous liquids including, but not limited to, normal tap water, waste water and body fluids such as blood and urine. Conventional coform fibrous nonwoven structures are used as absorbent products either alone, as in the form of wipers, or as components of other absorptive devices such as personal care absorbent articles including, but not limited to, diapers, training pants, incontinence garments, sanitary napkins, tampons, wound dressings, bandages and the like. It is desirable therefore, that the fibrous nonwoven composite structures of the present invention be able to withstand the rigors of their intended uses, and then, upon completion of the particular uses, the fibrous nonwoven web composite structures must become water-dispersible.

Certain polymers are only water-degradable when exposed to sufficient quantities of an aqueous liquid within a certain pH range. Outside this range, they will not degrade. Thus, it is possible to choose a pH-sensitive water-degradable polymer which will not degrade in an aqueous liquid or liquids in one pH range, for example a pH of 3 to 5, but which will become degradable in excess tap water. See for example, U.S. Pat. No. 5,102,688 to Eichel et al. which is incorporated herein by reference in its entirety. Thus, when fibrous nonwoven composites are exposed to body fluids such as urine, the water-degradable reinforcing fibers will not degrade. Subsequent to its use, such a fibrous nonwoven composite structure can be placed in excess quantities of higher pH liquids such as tap water which will cause the degradation of the water-degradable polymer making up the reinforcing fibers. As a result, the longer, more continuous reinforcing fibers will begin to break apart either by themselves or with sufficient agitation so that the discrete fibrous components, such as wood pulp fibers, can be reclaimed, recycled or disposed of by flushing. Examples of polymers which could be used to form this type of fiber could include acrylate ester/acrylic or methylacrylic acid copolymers and blends such as those designated as Findley Blends N-10, H-10, X-10, V-11 and U-15 as supplied by ATO-Findley Adhesives Inc. of Milwaukee, Wis., which is a division of Atochem Inc. These materials are stable at body pH conditions (or when buffered against body fluids), but will break-up in toilet water during the flushing process (excess water).

Another mechanism which can be used to trigger water-degradability is ion sensitivity. Certain polymers contain acid-based ($R\text{-}COO^-$ or $R\text{-}SO_3^-$) components which are held together by being mor hydrophobic at higher ionic concentrations. In a dry state, these polymers remain solid. In an aqueous solution which has a relatively high ion concentration, such as urine, the polymers still will remain relatively intact. However, when the same polymers are later exposed to larger quantities of water with diluted ion content such as can be found in a toilet bowl, the ion concentration will be diluted and the polymers become more hydrophilic, because they become polyelectrolytes, and will begin to break apart in the water. See for example, U.S. Pat. No. 4,419,403 to Varona which is incorporated herein by reference in its entirety. Polymers that are stable in solutions with highly ionic concentrations (for example, baby or adult urine and menses) could be sulfonated polyesters such as are supplied by the Eastman Chemical Company of Kingsport, Tenn. under the codes AQ29, AQ38, or AQ55. The Eastman AQ38 polymer is composed of 89 mole percent isophthalic acid, 11 mole percent sodium sulfoisophthalic acid, 78 mole percent diethylene glycol and 22 mole percent 1,4-cyclohexanedimethanol. It has a nominal molecular weight of 14,000 Daltons, an acid number less than 2, a hydroxyl number less than 10 and a glass transition temperature of 38° C. Other examples could be blends of copolymers of poly (vinyl alcohol) blended with polyacrylic or methylacrylic acid or polyvinylmethyl ether blended with polyacrylic or methylacrylic acid. The Eastman polymers are stable in solutions with high ion concentrations, but will break-up rapidly if placed in sufficient excess water such as tap water to dilute the ion concentration.

Other polymers that are stable in high ion concentrations include "triggered, water-dispersible polymers." By this it is meant that when the polymer is exposed to a trigger component, such as, for example, the soduim sulfate ion or sodium chloride ion, at a first concentration level found in normal tap water, the polymer disperses or disintegrates in no more than 30 minutes. However, when the polymer is exposed to the same trigger component at a second, higher concentration level typically found in body fluids, such as infant or adult urine, the polymer forming the first component remains stable and does not disperse. For example, Suitable examples of such first component include water-dispersible polyester or polyamide polymers, or copolymers, such as copolyester polymers available from National Starch and Chemical Company under the product designations 70-4395 and 70-4442. The inventors of the subject invention have discovered that water-dispersible fibrous nonwoven composites, having a component comprising a triggered, water-dispersible polymer are insensitive to the presence of a particular trigger component at a concentration level found in urine, yet are highly sensitive to and disperse in a period not exceeding 30 minutes in the presence of the same trigger component at a different, lower concentration level typically found in excess tap water, such as is found in toilet bowls. Thus, water-dispersible fibrous nonwoven composites formed from or incorporating the polymer fibers of the present invention are unaffected in terms of dispersibility when insulted with body fluids, such as urine, yet when disposed of in normal tap water tend to break apart as the triggerable, water-dispersible polymer disperses.

Yet another means for rendering a polymer degradable in water is through the use of temperature change. Certain polymers exhibit a cloud point temperature. As a result, these polymers will precipitate out of a solution at a particular temperature which is the cloud point. These polymers can be used to form fibers which are insoluble in water above a certain temperature but which become soluble and thus degradable in water at a lower temperature. As a result, it is possible to select or blend a polymer which will not degrade in body fluids, such as urine, at or near body temperature (37° C.) but which will degrade when placed in water at temperatures below body temperature, for example at room temperature (23° C.). An example of such a polymer is polyvinylmethylether which has a cloud point of 34° C. When this polymer is exposed to body fluids such as urine at 37° C., it will not degrade as this temperature is above its cloud point (34° C.). However, if the polymer is placed in water at room temperature (23° C.), the polymer will, with time, go back into solution as it is now exposed to water at a temperature below its cloud point. Consequently, the polymer will begin to degrade.

Blends of polyvinylmethylether and copolymers may be considered as well. Other cold water soluble polymers include poly(vinyl alcohol) graft copolymers supplied by the Nippon Synthetic Chemical Company, Ltd. of Osaka, Japan which are coded Ecomaty AX2000, AX10000 and AX300G.

Other polymers are water-degradable only when exposed to sufficient quantities of water. Thus, these types of polymers may be suitable for use in low water volume solution environments such as, for example, pantiliners, light incontinence products and baby or adult wipes. Examples of such materials could include NP2088, NP2074 or NP2120 aliphatic polyamides as supplied by the H. B. Fuller Company of Vadnais Heights, Minn.

Data concerning melt flow and DSC thermal analysis for these polymers is given in Table I.

TABLE I

| Polymer Type | Zero shear Melt Flow* Or Viscosity | 1000 $sec^{-1}$ shear Melt Flow* Or Viscosity | DSC Soft Temp (Range) |
|---|---|---|---|
| H.B. Fuller Code NP-2120 | 410 Pa.s @ 204° C. | | 142° C.–158° C. |
| H.B. Fuller Code NP-2068 | 95 Pa.s @ 204° C. | | 128° C.–145° C. |
| H.B. Fuller Code NP-2074 | 290 Pa.s @ 204° C. | 20 Pa.s @ 230° C. | 133° C.–145° C. |
| Nippon-Gohsei ECOMATY AX10000 | MFR = 100 | | 180° C. |
| Findley Blend N-10, Acrylate ester/ acrylic or methacrylic add | 200 Pa.s @ 140° C. | 30 Pa.s @ 190° C. | 117° C. |
| Findley Blend H-10, Acrylate ester/ acrylic or methacrylic add | 370 Pa.s @ 160° C. | | 131° C. |
| Findley Blend X-10, Acrylate ester/ acrylic or methacrylic add | | 30 Pa.s @ 190° C. | |
| Findley Blend U-15 | | 33.4 Pa.s @ 190° C. | |
| Findley Blend V-11, | | 34.2 Pa.s @ 190° C. | |
| Eastman Code AQ38S | 300 Pa.s @ 200° C. | | 120° C.–130° C. |
| National Starch Code 70-4442 | | 40 Pa.s @ 180 ° C. | 80° C.–100° C. |
| National Starch Code 70-4395 | | 22 Pa.s 180° C. | 80° C.–100° C. |

*ASTMD Test Method D-1238-906 (2.16 kg load at 190° C. for polyethylene)

Having described the various components which can be used to form a water-dispersible fibrous nonwoven composite structure according to the present invention, examples of several processes which could be used to form such materials will be described. One process for forming water-dispersible fibrous nonwoven web structures according to the present invention is shown in FIG. 1 of the drawings. In this drawing, a water-degradable polymer is extruded through a die head 10 into a primary gas stream 11 of high velocity, heated gas (usually air) supplied from nozzles 12 and 13 to attenuate the molten polymer into long, somewhat continuous fibers. As these water-degradable reinforcing fibers are being formed, the primary gas stream 11 is merged with a secondary gas stream 14 containing individualized wood pulp fibers or other materials including particulates so as to integrate the two different fibrous materials into a single fibrous nonwoven composite structure. The apparatus for forming and delivering the secondary gas stream 14 including the wood pulp fibers can be an apparatus of the type described and claimed in U.S. Pat. No. 3,793,678 to Appel. This apparatus comprises a conventional picker roll 20 having picking teeth for divellicating pulp sheets 21 into individual fibers. The pulp sheets 21 are fed radially, i.e. along a picker roll radius, to the picker roll 20 by means of rolls 22. As the teeth on the picker roll 20 divellicate the pulp sheets 21 into individual fibers, the resulting separate fibers are conveyed downwardly toward the primary air stream through a forming nozzle or duct 23. A housing 24 encloses the picker roll 20 and provides a passage 25 between the housing 24 and the picker roll surface. Process air is supplied to the picker roll in the passage 25 via duct 26 in sufficient quantity to serve as a medium for conveying the fibers through the forming duct 23 at a velocity approaching that of the picker teeth. The air may be supplied by a conventional means as, for example, a blower.

As illustrated in FIG. 1, the primary and secondary gas streams 11 and 14 are preferably moving perpendicularly to each other at the point of merger, although other merging angles may be employed if desired to vary the degree of mixing and/or to form concentration gradients through the structure. The velocity of the secondary stream 14 is substantially lower than that of the primary stream 11 so that the integrated stream 15 resulting from the merger continues to flow in the same direction as the primary stream 11. The merger of the two streams is somewhat like an aspirating effect whereby the fibers in the secondary stream 14 are drawn into the primary stream 11 as it passes the outlet of the duct 23. If a uniform structure is desired, it is important that the velocity difference between the two gas streams be such that the secondary stream is integrated with the primary stream in a turbulent manner so that the fibers in the secondary stream become thoroughly mixed with the meltblown fibers in the primary stream. In general, increasing velocity differences between the primary and secondary streams produce more homogenous integration of the two materials while lower velocities and smaller velocity differences will produce concentration gradients of components in the fibrous nonwoven composite structure. For maximum production rates, it is generally desirable that the primary air stream have an initial sonic velocity within the nozzles 12 and 13 and that the secondary air stream have a subsonic velocity. As the primary air stream exits the nozzles 12 and 13, it immediately expands with a resulting decrease in velocity.

Deceleration of the high velocity gas stream carrying the meltblown water-degradable meltblown fibers frees the fibers from the drawing forces which initially form them from the water-degradable polymer mass. As the water-degradable reinforcing fibers relax, they are better able to follow the minute eddies and to entangle and capture the relatively short wood pulp or other absorbent fibers while both fibers are dispersed and suspended in the gaseous medium. The resultant combination is an intimate mixture of wood pulp fibers and water-degradable reinforcing fibers integrated by physical entrapment and mechanical entanglement.

Attenuation of the water-degradable reinforcing fibers occurs both before and after the entanglement of these fibers with the pulp fibers. In order to convert the fiber blend in the integrated stream 15 into a fibrous nonwoven structure, the stream 15 is passed into the nip of a pair of vacuum rolls 30 and 31 having foraminous surfaces that rotate continuously over a pair of fixed vacuum nozzles 32 and 33. As the integrated stream 15 enters the nip of the rolls 31 and 33, the carrying gas is sucked into the two vacuum nozzles 32 and 33 while the fiber blend is supported and slightly compressed by the opposed surfaces of the two rolls 30 and 31. This forms an integrated, self-supporting fibrous nonwoven composite structure 34 that has sufficient integrity to permit it to be withdrawn from the vacuum roll nip and conveyed to a wind-up roll 35.

Figure 2:
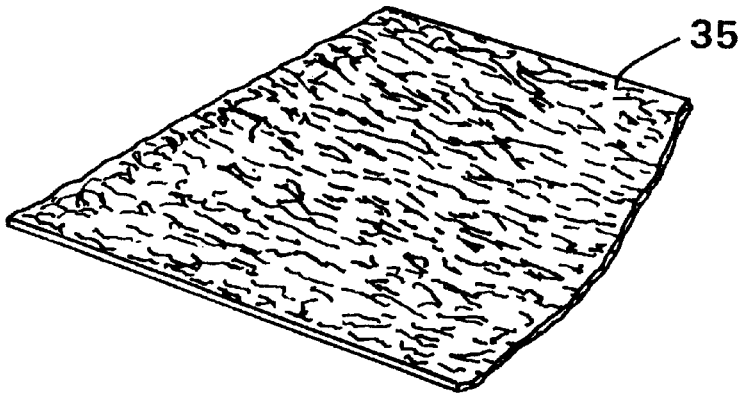
FIG. 2 is a perspective view of a fragment of a fibrous nonwoven composite structure produced by the method and apparatus of FIG. 1.

The containment of the wood pulp fibers in the integrated reinforcing fiber matrix is obtained without any further processing or treatment of the air laid composite structure. However, if it is desired to improve the strength of the fibrous nonwoven composite structure 34, as, for example, for use as a wiper, the composite web or structure 34 may be embossed or bonded using heat and/or pressure. The embossing may be accomplished using, for example, ultrasonic bonding and/or mechanical bonding as through the use of smooth and/or patterned bonding rolls which may or may not be heated. Such bonding techniques are well-known to those skilled in the art. In FIG. 1 the composite structure 34 is passed through an ultrasonic bonding station comprising an ultrasonic calendering head 40 vibrating against a patterned anvil roll 41. The bonding conditions (e.g. pressure, speed, power input) as well as the bonding pattern may be appropriately selected to provide the desired characteristics in the final product. See FIG. 2.

The relative weight percentages of the water-degradable reinforcing fibers and absorbent fibers may be varied according to the particular end use. Generally speaking, increasing the weight percent of the water-degradable reinforcing fibers will increase the overall tensile strength and integrity of the resultant fibrous composite nonwoven structure.

Figure 3:
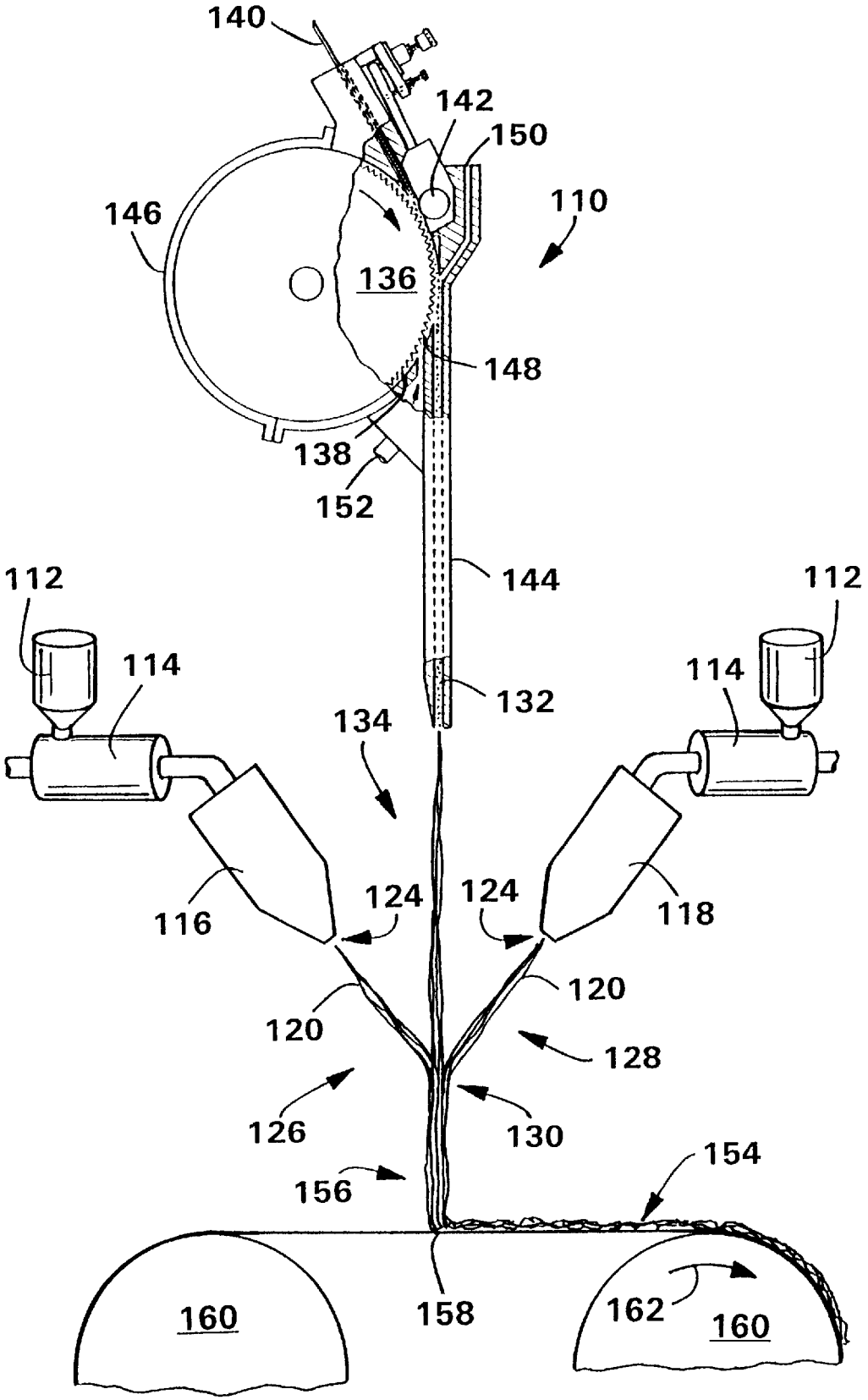
FIG. 3 is a partial schematic side elevation of another possible method and apparatus for producing water-dispersible fibrous nonwoven composite structures according to the present invention.
Figure 5:
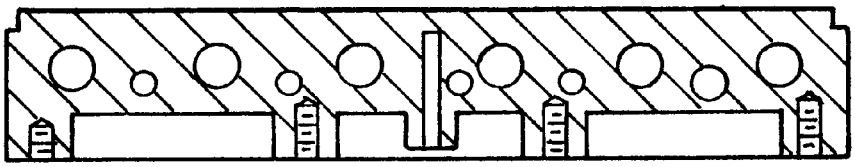
FIG. 5 is a cross-sectional view of the upper platen of FIG. 4.
Figure 4:
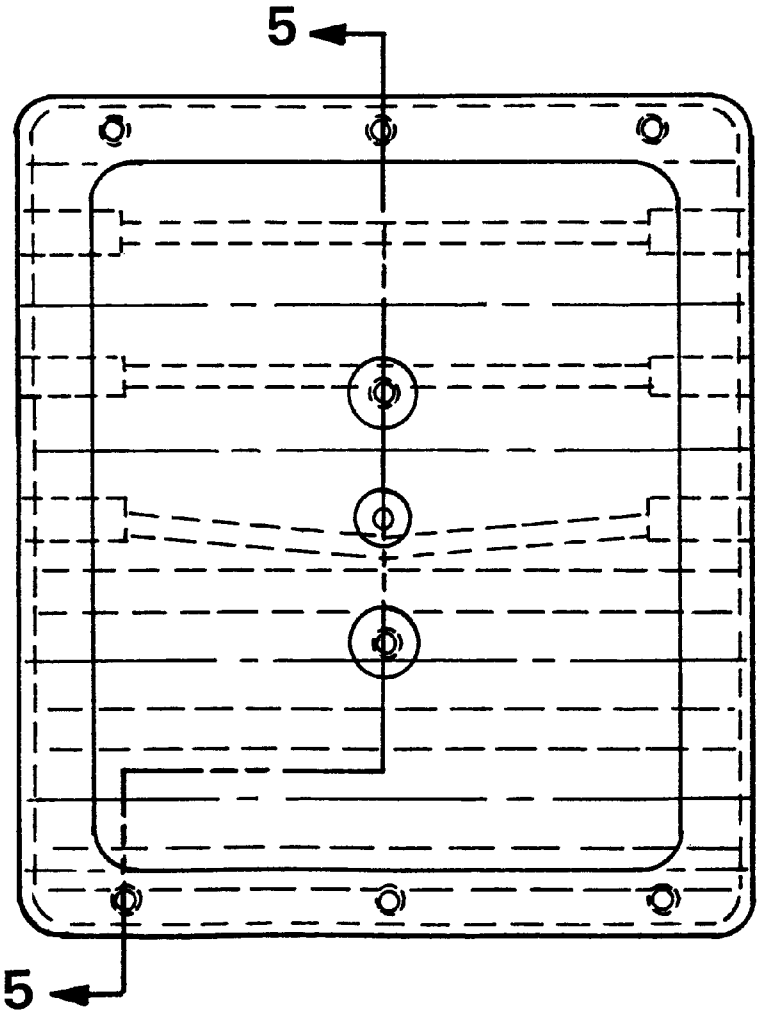
FIG. 4 is a plan view of the upper platen of a film pressing accessory used in forming polymer film samples.
Figure 7:
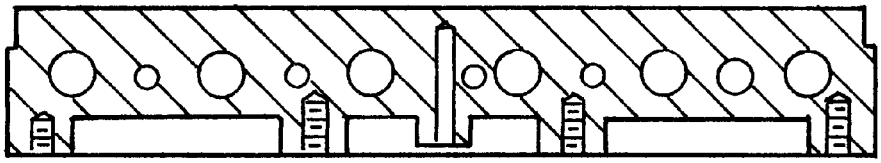
FIG. 7 is a cross-sectional view of the lower platen of FIG. 6.
Figure 6:
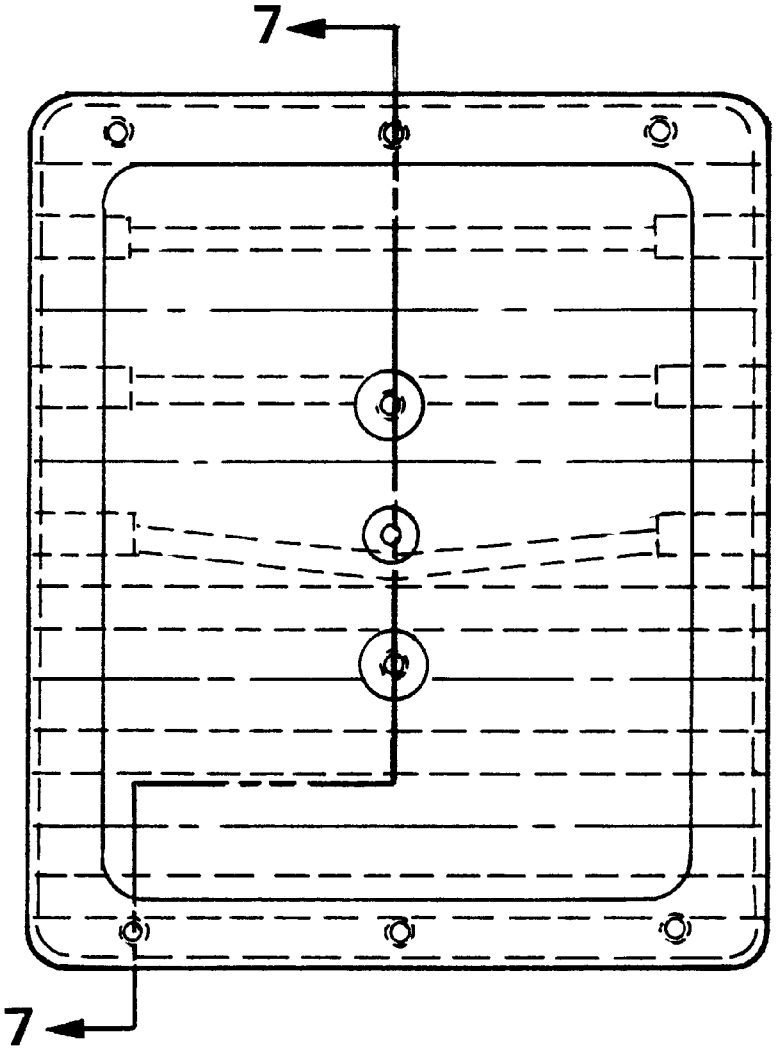
FIG. 6 is a plan view of the lower platen of the film pressing accessory used in forming polymer film samples.

Another formation process which might be used for forming water-dispersible fibrous nonwoven composites according to the present invention is shown in FIG. 3 of the drawings. In FIG. 3 there is shown an exemplary apparatus for forming an abrasion-resistant fibrous nonwoven composite structure which is generally represented by reference numeral 110. In forming the abrasion-resistant fibrous nonwoven composite structure of the present invention, pellets or chips, etc. (not shown) of a thermoplastic polymer are introduced into a pellet hoppers 112 of one or more extruders 114.

The extruders 114 have extrusion screws (not shown) which are driven by a conventional drive motor (not shown). As the polymer advances through the extruders 114, due to rotation of the extrusion screw by the drive motor, the polymer is progressively heated to a molten state. Heating the thermoplastic polymer to the molten state may be accomplished in a plurality of discrete steps with its temperature being gradually elevated as it advances through discrete heating zones of the extruder 114 toward two meltblowing dies 116 and 118, respectively. The meltblowing dies 116 and 118 may be yet another heating zone wherein the temperature of the thermoplastic resin is maintained at an elevated level for extrusion.

Each meltblowing die is configured so that two streams of usually heated attenuating gas per die converge to form a single stream of gas which entrains and attenuates the molten threads of water-degradable polymer, as the threads exit small holes or orifices 124 in the meltblowing die. The molten threads are attenuated into fibers 120, or depending upon the degree of attenuation, microfibers, of a small diameter which is usually less than the diameter of the orifices 124. Thus, each meltblowing die 116 and 118 has a corresponding single stream of gas 126 and 128 containing entrained and attenuated polymer fibers. The gas streams 126 and 128 containing polymer fibers are aligned to converge at an impingement zone 130.

One or more types of secondary fibers 132 and/or particulates are added to the two streams 126 and 128 of water-degradable thermoplastic polymer fibers or microfibers 120 at the impingement zone 130. Introduction of the secondary fibers 132 into the two streams 126 and 128 of the water-degradable thermoplastic polymer fibers 120 is designed to produce a graduated distribution of secondary fibers 132 within the combined streams 126 and 128 of thermoplastic polymer fibers. This may be accomplished by merging a secondary gas stream 134 containing the secondary fibers 132 between the two streams 126 and 128 of water-degradable thermoplastic polymer fibers 120 so that all three gas streams converge in a controlled manner.

Apparatus for accomplishing this merger may include a conventional picker roll 136 arrangement which has a plurality of teeth 138 that are adapted to separate a mat or batt 140 of secondary fibers into the individual secondary fibers 132. The mat or batt of secondary fibers 140 which is fed to the picker roll 136 may be a sheet of pulp fibers (if a two-component mixture of water-degradable thermoplastic polymer fibers and secondary pulp fibers is desired), a mat of staple fibers (if a two-component mixture of water-degradable thermoplastic polymer fibers and a secondary staple fibers is desired) or both a sheet of pulp fibers and a mat of staple fibers (if a three-component mixture of water-degradable thermoplastic polymer fibers, secondary staple fibers and secondary pulp fibers is desired). In embodiments where, for example, an absorbent material is desired, the secondary fibers 132 are absorbent fibers. The secondary fibers 132 may generally be selected from the group including one or more polyester fibers, polyamide fibers, cellulosic derived fibers such as, for example, rayon fibers, wood pulp fibers and superabsorbent fibers, multi component fibers such as, for example, sheath-core multi-component fibers, natural fibers such as silk fibers, wool fibers or cotton fibers or electically conductive fibers or blends of two or more of such secondary fibers. Other types of secondary fibers 132 such as, for example, polyethylene fibers and polypropylene fibers, as well as blends of two or more of other types of secondary fibers 132 may be utilized. The secondary fibers 132 may be microfibers or the secondary fibers 132 may be macrofibers having an average diameter of from about 300 micrometers to about 1,000 micrometers.

The sheets or mats 140 of secondary fibers 132 are fed to the picker roll 136 by a roller arrangement 142. After the teeth 136 of the picker roll 136 have separated the mat of secondary fibers 140 into separate secondary fibers 132 the individual secondary fibers 132 are conveyed toward the stream of thermoplastic polymer fibers or microfibers 120 through a nozzle 144. A housing 146 encloses the picker roll 136 and provides a passageway or gap 148 between the housing 146 and the surface of the teeth 138 of the picker roll 136. A gas such as air is supplied to the passageway or gap 148 between the surface of the picker roll 136 and the housing 146 by way of a gas duct 150. The gas duct 150 may enter the passageway or gap 148 generally at the junction 152 of the nozzle 144 and the gap 148. The gas is supplied in sufficient quantity to serve as a medium for conveying the secondary fibers 132 through the nozzle 144. The gas supplied from the duct 150 also serves as an aid in removing the secondary fibers 132 from the teeth 138 of the picker roll 136. The gas may be supplied by any conventional arrangement such as, for example, an air blower (not shown). It is contemplated that additives and/or other materials may be added to or entrained in the gas stream to treat the secondary fibers 132 or to provide desired properties in the resultant web.

Generally speaking, the individual secondary fibers 132 are conveyed through the nozzle 144 at about the velocity at which the secondary fibers 132 leave the teeth 138 of the picker roll 136. In other words, the secondary fibers 132, upon leaving the teeth 138 of the picker roll 136 and entering the nozzle 144 generally maintain their velocity in both magnitude and direction from the point where they left the teeth 138 of the picker roll 136. Such an arrangement, which is discussed in more detail in U.S. Pat. No. 4,100,324 to Anderson, et al. aids in substantially reducing fiber floccing.

The width of the nozzle 144 should be aligned in a direction generally parallel to the width of the meltblowing dies 116 and 118. Desirably, the width of the nozzle 144 should be about the same as the width of the meltblowing dies 116 and 118. Usually, the width of the nozzle 144 should not exceed the width of the sheets or mats 140 that are being fed to the picker roll 136. Generally speaking, it is desirable for the length of the nozzle 144 separating the picker from the impingement zone 130 to be as short as equipment design will allow.

The picker roll 136 may be replaced by a conventional particulate injection system to form a fibrous nonwoven composite structure 154 containing various secondary particulates. A combination of both secondary particulates and secondary fibers could be added to the water-degradable thermoplastic polymer fibers 120 prior to formation of the fibrous nonwoven composite structure 154 if a conventional particulate injection system was added to the system illustrated in FIG. 3. The particulates may be, for example, charcoal, day, starches, and/or hydrocolloid (hydrogel) particulates commonly referred to as super-absorbents.

Due to the fact that the water-degradable thermoplastic polymer fibers in the fiber streams 126 and 128 are usually still semi-molten and tacky at the time of incorporation of the secondary fibers 132 into the fiber streams 126 and 128, the secondary fibers 132 are usually not only mechanically entangled within the matrix formed by the water-degradable fibers 120 but are also thermally bonded or joined to the water-degradable fibers.

In order to convert the composite stream 156 of water-degradable fibers 120 and secondary fibers 132 into a fibrous nonwoven composite structure 154 composed of a coherent matrix of the water-degradable fibers 120 having the secondary fibers 132 distributed therein, a collecting device is located in the path of the composite stream 156. The collecting device may be an endless belt 158 conventionally driven by rollers 160 and which is rotating as indicated by the arrow 162 in FIG. 3. Other collecting devices are well known to those of skill in the art and may be utilized in place of the endless belt 158. For example, a porous rotating drum arrangement could be utilized. The merged streams of water-degradable fibers and secondary fibers are collected as a coherent matrix of fibers on the surface of the endless belt 158 to form the fibrous nonwoven composite structure or web 154. Vacuum boxes 164 assist in retention of the matrix on the surface of the belt 158. The vacuum may be set at about 2.5 to about 10 centimeters of water column.

The fibrous nonwoven composite structure 154 is coherent and may be removed from the belt 158 as a self-supporting nonwoven material. Generally speaking, the fibrous nonwoven composite structure 154 has adequate strength and integrity to be used without any post-treatments such as pattern bonding and the like. If desired, a pair of pinch rollers or pattern bonding rollers (not shown) may be used to bond portions of the material. Although such treatment may improve the integrity of the fibrous nonwoven composite structure 154 it also tends to compress and densify the structure.

Besides the foregoing processes, there are a number of other processes which are suitable for making various types of coform materials. For example, McFarland et al., U.S. Pat. No. 4,604,313 issued Aug. 5, 1986 is directed to a process for forming a multi-layered coform material including meltblown fibers and wood pulp fibers in one layer and a second layer which contains meltblown fibers, wood pulp fibers and superabsorbent particles. Another process is disclosed in Eschwey et al., U.S. Pat. No. 4,902,559 issued Feb. 20, 1990. This patent discloses a process wherein endless filaments are spun through a long spinneret into a passage to form what are more commonly referred to as spunbond fibers. At the same time, smaller hydrophilic or oleophilic fibers are fed into the stream of spunbond fibers. Optionally, superabsorbent particles may also be introduced into the foregoing fiber mixture. Both the McFarland et al. and Eschwey et al. patents are incorporated herein by reference in their entirety.

Having described various components and processes which can be used to form water-dispersible fibrous nonwoven composite structures, a series of Examples were prepared to demonstrate the present invention. Note that Examples 1–3 are not examples of the invention, Examples 4 and 5 are film examples of a triggerable, water dispersible polymer which may be used in the present invention, and Examples 6 and 7 are fibrous nonwoven composite structure examples according to the present invention.

EXAMPLES

Example I

In Example I water-dispersible fibrous nonwoven composite structures were made using a water soluble poly(vinyl alcohol) copolymer meltblown and fluff wood pulp in 20/80, 30/70, and 40/60 weight percent ratios (meltblown/pulp) based upon the total weight of the fibrous nonwoven composite structure. The polyvinyl alcohol copolymer had code name Ecomaty AX10000 and was manufactured by Nippon-Gohsei of Osaka, Japan. The meltflow rate of this AX10000 copolymer was 100 grams per 10 minutes at a temperature of 190° C. under 2.16 kilograms load using ASTM Test Method D-1238. The softening temperature of the AX10000 copolymer was 180° C. but it processed better at 210° C. to make meltblown microfibers. The fluff wood pulp had code number NF405 as received from Weyerhauser Corporation of Federal Way, Wash. The absorbent structure was produced utilizing a twin extruder and a pulp fiberizer system such as shown in FIG. 3. The coformed composites were formed on either a porous tissue carrier sheet or a spunbonded polypropylene nonwoven web carrier sheet. Optionally, the coform composites can be formed directly onto a forming wire. Basis weights of the coformed absorbent structures were 190 grams per square meter (gsm). The absorbent structures were then pattern bonded in a separate process using a heated calender nip with a total bond area of approximately 20 percent. When the coformed absorbent was placed in room temperature water and agitated, the meltblown fibers dissolved and the web broke apart in less than one minute and typically in less than 30 seconds. The 20/80 web was placed in a consumer study with adult women in a pantiliner intermenstrual test and the coformed absorbent was found to be capable of sustaining small fluid loads from urine and menses for periods up to six hours.

Example II

In Example II a water-dispersible fibrous nonwoven structure was made using a water soluble polyamide polymer meltblown and wood pulp fluff in a 30/70 meltblown/fluff weight ratio. The polyamide polymer had code number NP 2068 as received from H. B. Fuller Company of St. Paul, Minn. The viscosity of the NP 2068 polymer was 95 Pascal-seconds at a temperature of 204° C. The softening temperature range of the NP 2068 polymer was 128°–145° C. but it processed best at 210° C. to make meltblown microfibers. The fluff wood pulp had code number NF405 as received from the Weyerhauser Corporation of Federal Way, Washington. The absorbent structure was produced in the same fashion as Example I. The coformed composite was formed on a porous tissue carrier sheet. The basis weight of the coformed absorbent structure was 190 grams per square meter. When the coformed absorbent was placed in room temperature water and agitated, the meltblown fibers dissolved and the web broke apart in less than one minute and typically less than 30 seconds.

Example III

In Example III, a water-dispersible fibrous nonwoven composite structure was made using a water soluble polyamide polymer meltblown and wood pulp fluff in a 30/70 meltblown/fluff weight ratio. The polyamide polymer had code number NP 2074 as received from H.B. Fuller Company of St. Paul, Minn. The viscosity of the NP 2074 polymer was 290 Pascal-seconds at a temperature of 204° C. The softening temperature range of the NP. 2074 polymer was 133°–145° C. but it processed best at 210° C. to make meltblown microfibers. The fluff wood pulp had code number NF405 as received from the Weyerhauser Corporation of Federal Way, Wash. The absorbent structure was produced in the same fashion as Example I. The coformed composite was formed on a porous tissue carrier sheet and the basis weight of the coformed absorbent structure was 190 grams per square meter. When the coformed absorbent was placed in a- room temperature water and agitated, the meltblown fibers dissolved and broke apart in less than one minute and typically less than 30 seconds.

To further demonstrate the present invention, experimental pantiliners were made using the water-degradable coform materials outlined above in Examples I through III and were compared to a conventional coform containing pantiliner. The conventional pantiliner construction included a polyethylene baffle film, a 13 gram per square meter thermally embossed polypropylene spunbond liner and a 190 gram per square meter coform material as the absorbent core. The coform material comprised 30% by weight polypropylene meltblown fibers having an average fiber diameter of approximately 5 micrometers and 70% by weight based upon the weight of the absorbent core wood pulp fibers. The polypropylene meltblown and wood pulp fibers were intimately mixed with one another to form the absorbent core. To assemble the pantiliner structure, a water-based adhesive was used to laminate the polyethylene film to one side of the coform material and the polypropylene spunbond liner was thermally embossed to the other side of the coform material. To the exterior surface of the polyethylene film baffle there was applied a garment adhesive strip for attachment of the product to the undergarment of the wearer. This laminate formed the control as it did not contain any water-degradable reinforcing fibers but, instead, utilized the polypropylene meltblown fibers as the reinforcing means. A further description of such products can be found in U.S. Pat. No. 3,881,490 to Whitehead et al. and U.S. Pat. No. Des. 247,368 to Whitehead, both of which are incorporated herein by reference in their entirety.

The materials from Examples I through III, were also formed into pantiliners of the same general description as given above. In place of the 190 gsm polypropylene coform material in the control, 190 gsm 30% water-degradable reinforcing fiber/70% by weight wood pulp fiber coform composites according to Examples I, II and III were used. In addition, the polyethylene baffle was replaced with a water-degradable film and the baffle film was attached to the coform absorbent core by way of a hot melt adhesive instead of a water-based adhesive.

Twenty samples each of all four of the pantiliners including the control were subjected to a toilet flushing test. In the test, individual samples were placed at random in a 3.5 gallon toilet and were allowed to dwell in the toilet for 30 seconds before flushing. The control which contained standard coform material only flushed in six out of the twenty samples thereby indicating that only 30% of these pantliners would flush in a 3.5 gallon toilet. In contrast, with the three types of pantiliners using the water-dispersible materials of Examples I through III, all twenty samples for each material flushed. As a result, these materials were 100% flushable. A visual observation that was made while conducting this test was that the pantiliners according to Examples I through III absorbed water almost immediately and therefore sank directly to the bottom of the toilet bowl. In contrast, the control pantiliners which contained polypropylene fibers (which have a density less than 1 gram per cubic centimeter and a polyethylene baffle film with a density less than 1 gram per cubic centimeter) floated on the surface of the water in the toilet bowl. Consequently, the hydraulic driving force acting on the control product was much less than that acting on the experimental products. This demonstrated the lack of flushability of the control product because it could not realize the driving force of the priming jet in the toilet.

In addition, five samples each of the control and the pantiliners containing the materials of Examples I through III were separately introduced into a moving water system having a velocity of approximately 0.6 meters per second. In less than one minute, the absorbent core material of Examples I through III completely broke apart to the point that it was unrecognizable. In contrast, the absorbent core of the control remained substantially intact even after 30 minutes exposure time.

EXAMPLE IV

In Example IV, film samples formed from National Starch 70-4442 polymer were made using a polymer film pressing accessory and Carver Press (see FIGS. 4 through 7), then tensile tests were performed. The film pressing accessory include a fixed female lower platen and a male upper platen, both of which were electically heated and water-cooled. The depth of the lower platen was controlled by placing shims of 0.03302 centimeter (cm) thickness on both support arms of the film pressing accessory.

The upper and lower platen temperatures were set at 127° C. A silicon release liner was placed below the polymer sample on the lower platen. A silicon releases liner also was placed over the polymer sample. The platens were set to exert a pressure of 7,030 kilograms per square meter (kg/$m^2$). Upon achieving 7,030 kg/$m^2$, the pressure was released, then raised back to 7,030 kg/$m^2$ and maintained until the platen temperatures fell to about 35° C. The pressed films with release liners then were removed from the accessory. The resulting film samples had thicknesses of about 0.0127 cm, and were 25 cm in length and 20 cm wide.

Rectangular film samples were cut having a gauge length of 63.5 millimeters (mm) and a gauge width of 19.05 mm. Gauge thickness, as shown in Table II hereof, was measured with a Starrett#216 . A Liveco Vitrodyne 1000 tensile tester with submersible jaws and facings (available from John Chatillon & Sons, 7609 Buss Park Drive, Greensboro N.C.) was used to measure peak tensile stress. Jaw separation speed was set at 3,000 micrometers per second. Jaw separation was set at 32,000 micrometers. Test options were set to Auto Return. Force limit was set to 100%. Cutoff frequency was set at 200 Hertz. All thickness and peak tensile stress values shown in Table II are averages, based upon at least n=4 measurements.

The first series of samples (Sample 1) was tested for peak tensile stress in a dry condition. That is, the Sample 1 films were not placed in or subjected to an aqueous solution or medium prior to testing.

The second series of samples (Sample 2) was test for peak tensile stress after being submerged for one minute in 2,000 milliliters (ml of Blood Bank Saline, 0.85% NaCl, Catalog No. B3158-1 (available from Baxter Healthcare Corp.).

The third series of samples (Sample 3) was tested for peak tensile stress after being submerged for one minute in 2,000 ml of Blood Bank Saline, 0.85% NaCl, Catalog No. B31581 with 1.0% sulfate anion added.

The fourth series of samples (Sample 4) was tested for peak tensile stress after being submerged for one minute in 2,000 ml of deionized water having a resistance greater than or equal to 18 megaohms.

The fifth series of samples (Sample 5) was tested for peak tensile stress after being submerged for thirty minutes in 2,000 ml of deionized water having a resistance greater than or equal to 18 megaohms.

The thickness and peak tensile stress data for Samples 1–7 were as follows:

TABLE II

| Sample No. | No. of Measurements | Thickness (micrometers) | Peak Tensile Stress (Mpa) |
|---|---|---|---|
| 1 | 5 | 0.322 | 4.51 |
| 2 | 5 | 0.291 | 4.32 |
| 3 | 4 | 0.201 | 4.43 |
| 4 | 5 | 0.326 | 0.07 |
| 5 | 5 | 0.216 | 0.00 |

The peak tensile stress date shown herein illustrates that film sample formed of the National Starch 70-442 copolyester polymer are significantly affected by the presence of the sulfate anion (a kosmotrope) in solution, which tends to build or increase tensile strength at high concentration levels, such as found in infant or adult urine. However, in the presence of excess water, in which the concentration of the sulfate anion is below the critical precipitation concentration (i.e., approximately 100 parts per million), the copolyester polymer (or copolymer) precipitation from solution, weakening the film strength whereby the film tends to disperse.

EXAMPLE V

In this Example, film samples formed from National Starch 70-4442 polymer were tested for dispersion in deionized water as compared to commercially available bath tissue, substantially in accordance with "A Simple Test for Dispersion of Wet Chop Fiberglass in Water", published in the 1996 TAPPI Proceedings Nonwoven Conference and incorporated herein by referee Five 1.5 inch (38.1 mm) long by 1.5 inch (38.1 mm) wide film samples (Sample 1) having an average weight of 0.2525 gram were placed in 1,500 ml of deionized water having a resistance greater than or equal to 18 megaohms contained in a 2,000 ml Kimax beaker, No. 14005. A Fisher Scientific Stirrer (Magnetic), Catalog No. 11-498-78H, was set at a speed setting of 7 to agitate the content of the beaker. Using a standard timer, the period of time was measured from the point the stirrer was activated until the onset of dispersion occurred, which was defined as the point at which the first piece of sample film material broke off or away from the remaining portion of the film sample, and until full dispersion occurred, which was defined as the point at which the sample film material had dispersed into pieces having diameters not exceeding about 0.25 inch (6.35 mm).

Five single sheets of Kleenex® Premium Bath Tissue (Sample 2) available from Kimberly-Clark Corp. of Dallas, Tex., each measuring 4.0 inches (10.2 cm) by 4.5 inches (11.4 cm) and having an average weight of 0.3274 gram, were subjected to the same test procedure and the periods for the onset of dispersion and full dispersion were measured.

Finally, this test procedure was repeated by placing a single 1.5 inch (38.1 mm) by 1.5 inch (38.1 mm) sample of film (Sample 3) made from National Starch 70-4442 polymer, having a weight 0.2029 gram, in 1,500 ml of Blood Bank Saline, 0.85% NaCl, Catalog No. B3158-1 with 0.1% sulfate anion added. The periods for onset of dispersion and full dispersion were measured. As can be seen from Table III below, no dispersion occurred for a period of 15 minutes, at which time the test was terminated.

TABLE III

| Sample No. | No. of Measurements | Onset of Dispersion (seconds) | Full Dispersion (seconds) |
|---|---|---|---|
| 1 | 5 | 57.2 | 82.4 |
| 2 | 5 | 45.4 | 122.0 |
| 3 | 1 | None after 15 minutes | None after 15 minutes |

The results of the test procedures performed under this Example further illustrate that fibers employing the triggered, water-dispersible 70-442 polymer, in accordance with the present invention, will disperse in the presence of a particular trigger component, such as the sulfate anion, at a concentration level found in excess water, while remain substantially unaffected when exposed to the same trigger component at a concentration level typically found in body fluids, such as infant or adult urine. Moreover, the rate of dispersion compares favorably to that of commercial bath tissue products, which generally are disposed of in normal tap water, such as is found in toilet bowls.

Example VI

In Example VI four water-dispersible fibrous nonwoven composite structures were made using an ionically triggerable water degradable copolyester meltblown and fluff wood pulp in 35/65, 30/70, 30/70 and 25/75 weight percent ratios (meltblown/pulp) based upon the total weight of the fibrous nonwoven composite structure. The copolyester had code name 70-4395 and was manufactured by National Starch. The fluff wood pulp had code number NF405 as received from Weyerhauser Corporation of Federal Way, Wash. The absorbent structure was produced utilizing a twin extruder and a pulp fiberizer system such as shown in FIG. 3. The coformed composites were formed directly onto a forming wire using a melt temperature of about 170° C. Basis weights of the coformed absorbent structures were 75, 190, 150 and 75 grams per square meter (gsm) respectively. The absorbent structures were then pattern bonded in a separate process using a heated calender nip at about 40–50° C. with a total bond area of approximately 20 percent. When the coformed absorbent was placed in room temperature water and agitated, the meltblown fibers dissolved and the webs broke apart in less than 15 minutes.

Thus it can be seen the water-dispersible fibrous nonwoven composite structures of the present invention may be able to provide a wide variety of applications where products are required that will readily disperse in water after their intended use cycle. It should further be noted that the present invention is directed at dry and substantially dry applications, for example, in pantiliners, where only a small amount, generally 0.25 to 0.5 grams, of fluid is absorbed. This invention would be unsuitable for wet applications such as in wet wipes where, for example, solutions such as those containing phospholipids and benzoic acid are saturated onto a wipe, as any low ion solution would cause the composite to break apart. This invention, further, does not use (i.e., is essentially free of) non-triggerable water dispersible reinforcing fibers. Wet applications would be better suited by the invention described in U.S. patent application Ser. No. 08/774,417 filed Dec. 31, 1996, entitled COFORMED DISPERSIBLE NONWOVEN FABRIC BONDED WITH A HYBRID SYSTEM AND METHOD OF MAKING SAME, commonly assigned, to Jackson, Mumick, Ono, Pomplun and Wang, with attorney docket number 12883, which requires non-triggerable reinforcing fibers, and which is incorporated herein in its entirety.

Having thus described the invention in detail, it should be apparent that various modifications and changes can be made to the present invention without the departing from the spirit and scope of the following claims.

What is claimed is:

1. A water-dispersible fibrous nonwoven composite structure comprising a matrix of meltspun water-degradable reinforcing fibers and a multiplicity of discrete absorbent fibers disposed within said matrix of meltspun water-degradable reinforcing fibers wherein said meltspun fibers further comprise a water-dispersible polymer that remains stable in the presence of an aqueous solution having greater than about 1000 ppm of a kosmotrope and disperses in a period not exceeding 30 minutes in an aqueous solution having less than about 1000 ppm of a kosmotrope.

2. The water-dispersible fibrous nonwoven composite structure of claim 1 wherein said absorbent fibers are staple fibers having average fiber lengths of approximately 18 millimeters or less.

3. The water-dispersible fibrous nonwoven composite structure of claim 1 wherein said absorbent fibers are wood pulp fibers.

4. The water-dispersible fibrous nonwoven composite structure of claim 1 which further includes a particulate material within said matrix.

5. The water-dispersible fibrous nonwoven composite structure of claim 4 wherein said particulate material is a superabsorbent.

6. The water-dispersible fibrous nonwoven composite structure of claim 4 wherein said particulate material is an odor reducing agent.

7. The water-dispersible fibrous nonwoven composite structure of claim 1 wherein said meltspun water-degradable reinforcing fibers comprise water-degradable polyamides.

8. The water-dispersible fibrous nonwoven composite structure of claim 1 wherein said meltspun water-degradable reinforcing fibers comprise polyester.

9. A water-dispersible fibrous nonwoven composite according to claim 8 wherein said meltspun water-degradable reinforcing fibers comprise a water-dispersible copolyester.

10. A water-dispersible fibrous nonwoven composite according to claim 1 wherein said meltspun water-degradable reinforcing fibers disperse in a period not exceeding 15 minutes.

11. A personal care absorbent article which includes a water-dispersible fibrous nonwoven composite structure according to claim 1.

12. The personal care absorbent article of claim 11 wherein said article is a wiper.

13. The personal care absorbent article of claim 11 wherein said article is a diaper.

14. The personal care absorbent article of claim 11 wherein said article is a training pant.

15. The personal care absorbent article of claim 11 wherein said article is a pantiliner.

16. The personal care absorbent article of claim 11 wherein said article is a sanitary napkin.

17. The personal care absorbent article of claim 11 wherein said article is a incontinence device.

18. The personal care absorbent article of claim 11 wherein said article is a wound dressing.

19. The personal care absorbent article of claim 11 wherein said article is a bandage.

20. A water-dispersible fibrous nonwoven composite structure comprising a matrix of meltspun water-degradable reinforcing fibers and a plurality of particles disposed within and held by said matrix, wherein said meltspun water-degradable reinforcing fibers further comprising a water-dispersible polymer having a first peak tensile stress in the presence of an aqueous solution having greater than about 1000 ppm of a kosmotrope and a second peak tensile stress in the presence of an aqueous solution having less than about 1000 ppm of a kosmotrope, said second peak tensile stress being at least 90% less than said first peak tensile stress.

21. The water-dispersible fibrous nonwoven composite structure of claim 20 wherein said particles comprise a superabsorbent.

22. The water-dispersible fibrous nonwoven composite structure of claim 20 wherein said particles comprise an odor-reducing material.

23. A water-dispersible fibrous nonwoven composite structure consisting essentially of a matrix of meltspun, ionically triggerable, water-degradable reinforcing fibers and a multiplicity of discrete absorbent fibers disposed within said matrix, wherein said composite structure disperses in a period not exceeding 30 minutes in deionized water.

* * * * *

UNITED STATES PATENT AND TRADEMARK OFFICE

CERTIFICATE OF CORRECTION

PATENT NO. : 5,948,710

DATED : September 7, 1999

INVENTOR(S) : Williams S. Pomplun, et al

It is certified that error appears in the above-identified patent and that said Letters Patent is hereby corrected as shown below:

Column 1, Line 31, "U.S. U.S. Pat." should read -- U.S. Pat. --

Column 2, Line 38, "dogging" should read -- clogging --

Column 3, Line 8, "as such as a" should read -- such as a --

Column 7, Line 26, "Suitable" should read -- suitable --

Column 12, Line 31, "day" should read -- clay --

Column 14, Line 35, "in a- room" should read -- in room --

Column 16, Line 1, "Starrett #216" should read -- Starrett #216 micrometer --

Column 16, Line 45, "date" should read -- data --

Column 16, Line 46, "sample" should read -- samples --

Column 16, Line 46, "70-442" should read -- 70-4442 --

UNITED STATES PATENT AND TRADEMARK OFFICE

CERTIFICATE OF CORRECTION

PATENT NO. : 5,948,710

DATED : September 7, 1999

INVENTOR(S) : Williams S. Pomplun, et al

It is certified that error appears in the above-identified patent and that said Letters Patent is hereby corrected as shown below:

Column 16, Line 64, "referee" should read -- reference --

Column 17, Line 40, "70-442" should read -- 70-4442 --

Signed and Sealed this

Fifth Day of September, 2000

*Attest:*

*Attesting Officer*

Q. TODD DICKINSON

*Director of Patents and Trademarks*